US009389019B2

(12) United States Patent
Thillen et al.

(10) Patent No.: US 9,389,019 B2
(45) Date of Patent: Jul. 12, 2016

(54) ROTARY CHARGING DEVICE FOR SHAFT FURNACE

(71) Applicant: PAUL WURTH S.A., Luxembourg (LU)

(72) Inventors: Guy Thillen, Diekirch (LU); Christian Benoit Thix, Luxembourg (LU); Lionel Hausemer, Sandweiler (LU)

(73) Assignee: PAUL WURTH S.A., Luxembourg (LU)

( * ) Notice: Subject to any disclaimer, the term of this patent is extended or adjusted under 35 U.S.C. 154(b) by 0 days.

(21) Appl. No.: 14/415,886

(22) PCT Filed: Jul. 15, 2013

(86) PCT No.: PCT/EP2013/064913

§ 371 (c)(1),
(2) Date: Jan. 20, 2015

(87) PCT Pub. No.: WO2014/012891

PCT Pub. Date: Jan. 23, 2014

(65) Prior Publication Data

US 2015/0211793 A1 Jul. 30, 2015

(30) Foreign Application Priority Data

Jul. 18, 2012 (LU) ..... 92045

(51) Int. Cl.
*F27B 1/20* (2006.01)
*C21B 7/20* (2006.01)
(Continued)

(52) U.S. Cl.
CPC ... *F27B 1/20* (2013.01); *C21B 7/00* (2013.01); *C21B 7/20* (2013.01); *F27D 3/00* (2013.01); *F27D 3/0025* (2013.01); *F27D 3/0033* (2013.01); *F27D 3/10* (2013.01)

(58) Field of Classification Search
CPC ..... F27B 1/20; F27D 3/00; F27D 3/0025; F27D 3/0033; F27D 3/10
USPC ..... 414/147, 148
See application file for complete search history.

(56) References Cited

U.S. PATENT DOCUMENTS 3,693,812 A 9/1972 Mahr et al.
3,814,403 A * 6/1974 Legille ..... C21B 7/20 414/206

(Continued)

FOREIGN PATENT DOCUMENTS

EP 0863215 A1 9/1998
EP 2487440 A1 8/2012

(Continued)

OTHER PUBLICATIONS

International Search Report and Written Opinion issued Feb. 17, 2014 re: Application No. PCT/EP2013/064913; citing: US 2012/045298 A1, JP 63 096205 A, WO 2010/139776 A1, WO 2010/139761 A1, WO 2012/016902 A1 and FR 2 692 595 A1.

(Continued)

*Primary Examiner* — Kaitlin Joerger
(74) *Attorney, Agent, or Firm* — Cantor Colburn LLP

(57) ABSTRACT

A rotary charging device for a shaft furnace comprising: a stationary housing (16) and a suspension rotor (22) that is supported so that it can rotate about a substantially vertical axis (A), a charge distributor (28) being pivotally suspended to the suspension rotor (22). Rotary drive means are provided for rotating the suspension rotor about its axis (A) and tilting drive means for pivoting the charge distributor (28) about a substantially horizontal pivoting axis (B), independently from said rotary drive means. The tilting drive means are mounted onto the suspension rotor (22) and rotate therewith; they comprise: an electric tilting motor ($M_B$) is installed inside the main casing (36) and having a substantially horizontal output shaft (52); a tilting input gear (54) driven by the tilting motor output shaft; and a tilting output gear (56) rotationally integral with a suspension arm (34) of said chute distributor (28), said tilting input gear meshing with said tilting output gear.

18 Claims, 8 Drawing Sheets

(51) Int. Cl.

| | |
|---|---|
| ***F27D 3/00*** | (2006.01) |
| ***F27D 3/10*** | (2006.01) |
| ***C21B 7/00*** | (2006.01) |

(56) References Cited

U.S. PATENT DOCUMENTS

| | | | | |
|---|---|---|---|---|
| 6,580,744 | B1 * | 6/2003 | Irnich | F27B 1/20 373/79 |
| 7,861,614 | B2 * | 1/2011 | Sim | B65G 69/0441 414/206 |
| 8,419,336 | B2 * | 4/2013 | Fletcher | C21B 7/20 414/207 |
| 8,701,856 | B2 * | 4/2014 | Tomisaki | C21B 7/20 193/16 |
| 8,920,710 | B2 * | 12/2014 | Thillen | C21B 7/20 266/197 |
| 9,133,529 | B2 * | 9/2015 | Thillen | C21B 7/20 |
| 9,146,057 | B2 * | 9/2015 | Thillen | C21B 7/20 |
| 2012/0045298 | A1 * | 2/2012 | Thillen | C21B 7/20 414/206 |
| 2012/0070253 | A1 * | 3/2012 | Thillen | C21B 7/20 414/199 |
| 2015/0204608 | A1 | 7/2015 | Thillen et al. | |
| 2015/0211793 | A1 | 7/2015 | Thillen et al. | |

FOREIGN PATENT DOCUMENTS

| | | | |
|---|---|---|---|
| FR | 2692595 | A1 | 12/1993 |
| JP | 57116719 | A | 7/1982 |
| JP | 58207303 | A | 12/1983 |
| JP | 63096205 | A | 4/1988 |
| WO | 0224962 | A1 | 3/2002 |
| WO | 2007082633 | A1 | 7/2007 |
| WO | 2010139761 | A1 | 12/2010 |
| WO | 2010139776 | A1 | 12/2010 |
| WO | 2011023772 | A1 | 3/2011 |
| WO | 2012016902 | A1 | 2/2012 |

OTHER PUBLICATIONS

International Search Report issued Jan. 22, 2014 and International Preliminary Report on Patentability issued on Nov. 7, 2014 re: Application No. PCT/EP2013/064912; citing: EP 2 487 440 A1, WO 02/24962 A1, US 2012/045298 A1, WO 2010/139761 A1, WO 2010/139776 A1, JP 58 207303 and JP 57 116719 A.

* cited by examiner

ROTARY CHARGING DEVICE FOR SHAFT FURNACE

FIELD OF THE INVENTION

The present invention generally relates to a charging installation for a shaft furnace and in particular to a rotary charging device for distributing charge material in a shaft furnace. More specifically, the invention relates to the type of device that is equipped with a chute for circumferential and radial distribution of the charge material.

BACKGROUND OF THE INVENTION

Rotary charging devices using a chute for circumferential and radial distribution of the charge material have been known for several decades, mainly thanks to the present Applicant who brought the BELL LESS TOP® to industry in the early 1970s.

Such a rotary charging device is e.g. described in U.S. Pat. No. 3,693,812. It comprises a suspension rotor and a chute adjustment rotor that are supported in a stationary housing so as to be rotatable about a substantially vertical rotation axis. The chute is suspended to the suspension rotor so that it rotates with the latter for circumferential distribution of charge material. Furthermore, the chute is suspended to be pivotally adjustable about a substantially horizontal axis for radial distribution of charge material. The suspension rotor and the adjustment rotor are driven by a differential drive unit that is equipped with a main rotation drive, namely an electric motor, and an adjustment drive, namely an electric motor. The latter allows creating differential rotation between the suspension rotor and the adjustment rotor. A pivoting mechanism is provided for angular adjustment of the chute. This mechanism, which is connected to the chute and actuated by the rotor, transforms a variation in angular displacement between the suspension rotor and the adjustment rotor due to differential rotation, into a variation of the pivotal position i.e. the tilt angle of the chute.

The rotary charging device of U.S. Pat. No. 3,693,812 is further equipped with a drive unit for driving the two rotors. This unit is enclosed in a casing arranged on the stationary housing that supports the rotors and the chute. The casing has a primary input shaft; a secondary input shaft; a first output shaft, hereinafter called rotation shaft; and a second output shaft, hereinafter called adjustment shaft. The primary input shaft is driven by the main rotation drive. Inside the casing, a reduction mechanism connects the primary input shaft to the rotation shaft, which extends vertically inside the stationary housing where it is provided with a gearwheel that meshes with a gear ring of the suspension rotor. The adjustment shaft also extends vertically into the stationary housing where it is provided with a gearwheel that meshes with a gear ring of the adjustment rotor. Inside the casing of the drive unit, the rotation shaft and the adjustment shaft are interconnected by means of an epicyclic differential mechanism, i.e. a sun-and-planet gear train. The latter mainly comprises a horizontal annulus (ring gear) that has external teeth meshing with a gearwheel on the rotation shaft; a sun gear that is connected to the secondary input shaft; at least two planet gears that mesh with internal teeth of the annulus and with the sun gear. This sun-and-planet gear train is dimensioned so that the rotation shaft and the adjustment shaft have the same rotational speed imparted by the main rotation drive when the secondary input shaft is stationary, i.e. when the adjustment drive is at stop. The adjustment drive is a reversible drive and connected to the secondary input shaft. By virtue of the differential mechanism, the adjustment drive allows driving the adjustment shaft at a faster and at a lower rotational speed than the rotation shaft to thereby produce a relative i.e. differential rotation between the suspension rotor and the adjustment rotor. The pivoting mechanism transforms such differential rotation into pivoting motion of the chute.

Such rotary charging device with distribution chute has proven very successful in industry and various manufacturers have developed their own versions. In the majority of designs, the drive motors, drive unit, the rotation shaft and adjustment shaft are arranged vertically, generally on the top of the stationary housing. As described above, the rotation drive may be achieved relatively easily by a pinion engaging a ring gear attached to the supporting rotor. The tilting drive is more complex as the torque provided by the vertical electric motor has to be converted in such a way to be able to pivot the distribution chute about the horizontal axis. In this regard, the design of the tilting mechanism has led to many developments, using connecting rods, cables, or hydraulic cylinders and specially designed gears. In particular, the tilting drive unit described above is a key component of the device for distributing charge material. Since it is custom made, it represents a significant part of the total cost of the device. Moreover, in order to ensure continuous operation of the furnace when the drive unit requires servicing or major repair, a complete spare unit is typically kept in stock by the furnace operator.

Over the years, the motivations that lead to the development of new designs where:

- improving the compactness of the device, in particular for small/medium blast furnace installations;
- improving the reliability of the rotary and tilting drive mechanisms;
- facilitating the access to the stationary housing, which may be difficult complicated by the various external casings mounted thereto;
- reducing the quantity of casing openings (seals, gaskets . . . );
- improving the reliability of the rotary and tilting drive mechanisms.

In EP 0 863 215 it has been proposed to actuate the chute by means of an electrical motor arranged on the rotating part (suspension rotor) that supports the chute. This solution eliminates the need for a highly developed mechanical gear arrangement for varying the chute inclination. It does however require means for electric energy transfer, from the stationary part to the rotatable part, in order to power the electric motor on the chute-supporting rotor.

The solution provided in EP 0 863 215 seems however unfinished and inappropriate for practical use to face the harsh industrial condition, with substantial dust and heat. The power supply to the tilting drive is another problem, not addressed therein.

BRIEF SUMMARY OF THE INVENTION

The invention provides an alternative design of rotary charging device allowing an easy control of the distribution chute, with simple and robust mechanics.

According to the present invention, a rotary charging device comprises:

a stationary housing for mounting on the throat of the shaft furnace;

a suspension rotor in said stationary housing that is supported so that it can rotate about a substantially vertical axis, said suspension rotor and stationary housing cooperating to form the main casing of said rotary charging device;

a charge distributor pivotally suspended to said suspension rotor;

rotary drive means for rotating the suspension rotor about its axis;

tilting drive means for pivoting said charge distributor about a substantially horizontal pivoting axis, independently from said rotary drive means, wherein:

said tilting drive means are mounted to said suspension rotor so as to rotate therewith, and a tilting motor, preferably an electric motor, is installed inside the main casing and has a substantially horizontal output shaft, and a tilting input gear is driven by said tilting motor output shaft, and a tilting output gear is rotationally integral with a suspension arm of the chute distributor, said tilting input gear meshing with said tilting output gear.

The invention hence provides a rotary distribution device for shaft furnaces where the rotational and tiling drives can be separately/independently controlled. It shall be appreciated that the tilting motor with associated driving gearing/means are arranged inside the main housing and carried by the suspension rotor so as to rotate therewith. Depending on the embodiment, the tilting motor can be directly supported by the suspension rotor, or laterally deported to be carried along by the suspension rotor as it rotates, whereby in both cases it is arranged so as to rotate with the suspension rotor.

The present rotary distribution device has many benefits:

- the tilting and rotary drive means are decoupled/independent, which facilitates the mechanical design of the transmission mechanisms;
- the horizontal installation of the tilting motor frees up some space in the region above the stationary housing;
- the tilting motor is arranged inside the main casing and thus protected from the harsh outside environment.

Preferably, the suspension rotor comprises a cylindrical body and a substantially horizontal bottom flange; such configuration is however not limitative and other designs may be used. The tilting drive means may thus be mounted onto and supported by this bottom flange. The installation of the tilting motor (with its output shaft horizontal) on the suspension rotor's bottom flange greatly simplifies the tilting drive mechanism, in particular because it is no longer required to transform the rotation of a vertical shaft into a horizontal movement.

In general, the rotary drive means may comprise a rotary motor, preferably electric motor, which may be mounted outside or inside the stationary housing (with its output shaft vertical or horizontal) and operatively coupled to the suspension rotor by a main transmission. The rotary motor may e.g. be mounted so that its output shaft is substantially vertical and said main transmission comprises a input gear driven by said output shaft and meshing with a toothed ring coaxial with and rotationally integral with said rotary support.

However, as for the tilting motor, the rotary motor is preferably mounted laterally to the stationary housing, preferably inside the main casing, so that its output shaft is substantially horizontal. In such case, the rotary drive means may comprise a main transmission with an input gear driven by the rotary motor's output shaft and meshing with a toothed ring coaxial and rotationally integral with the rotary support. The lateral arrangement of the rotary motor again frees up some space above the rotary distribution device and reduces its height. The overall height of the top charging equipment above the blast furnace is thus reduced, also meaning a reduction of costs. As described below, depending on the embodiment, the overall height of the stationary housing may be reduced by about 1 m, from 1.5 m down to 0.5 m.

In a particularly compact embodiment, the toothed ring of the rotary drive means is fixed to an inferior side of the suspension rotor's bottom flange and the input gear driven by the rotary motor is arranged below the bottom flange so as to mesh with said toothed ring. In such embodiment, the suspension rotor may be rotationally supported by a rolling bearing mounted to the top ring of said shaft furnace, one race of said rolling bearing being fixed to the inferior side of the suspension rotor's bottom flange.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
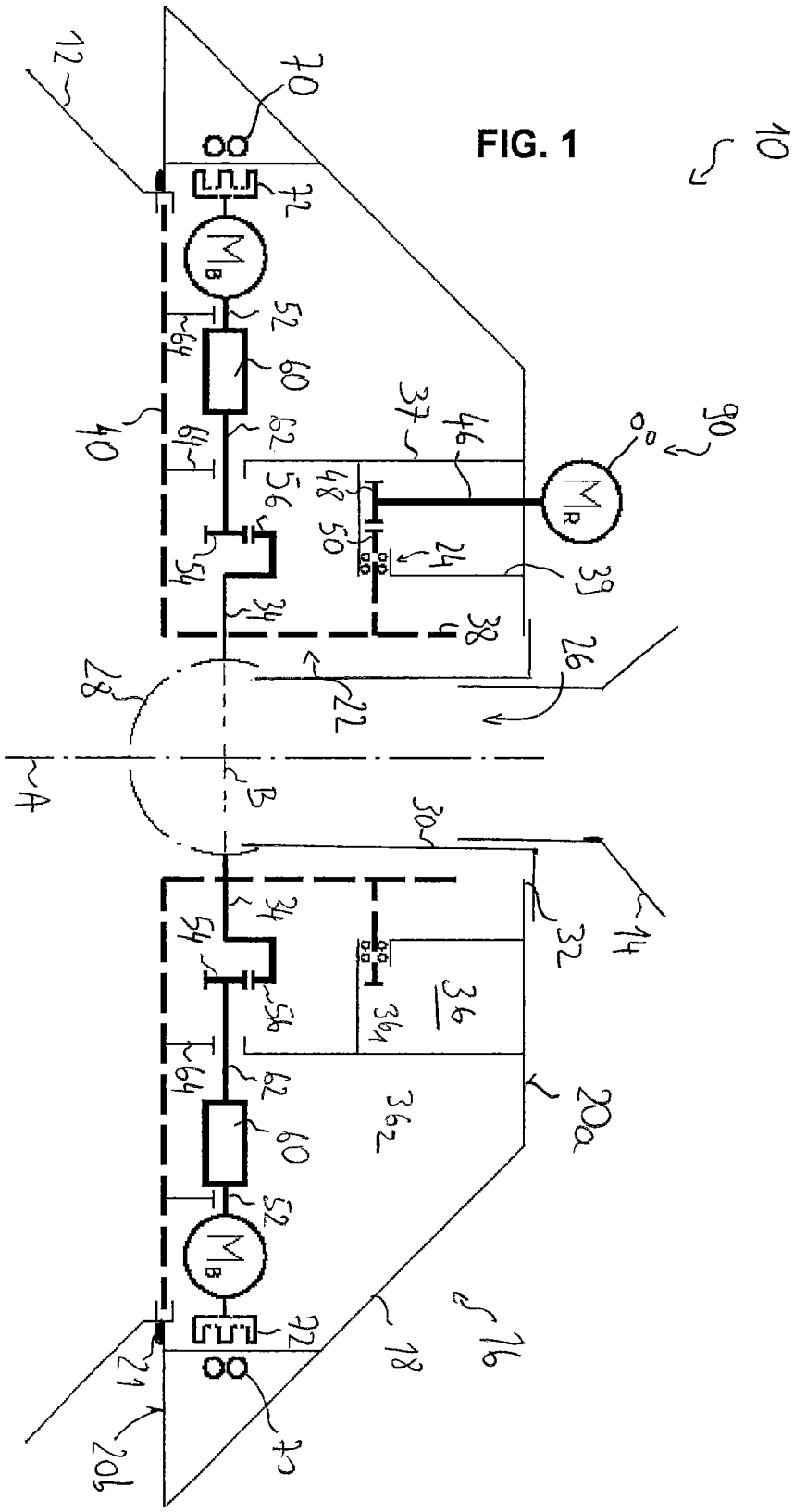
FIG. 1: is a schematic diagram, in cross-section, of a first embodiment of the present rotary charging device.

FIG. 1 shows the main elements of a first embodiment of rotary distribution device 10 for distributing bulk charge material ("burden") into a shaft furnace, especially onto the stock-line of a blast furnace. As it is known in the art, the device 10 is part of a top charging installation and is arranged to close the top opening of the reactor, e.g. on the throat 12 of the blast furnace. The distribution device 10 is fed with charge material from one or more intermediate storage hoppers (not shown), e.g. according to a configuration as disclosed in WO 2007/082633. In FIG. 1, a funnel 14 guides the charge material discharged from the hoppers into the rotary distribution device 10.

The distribution device 10 has a fixed structure forming a stationary housing 16 sealing mounted to the furnace throat 12, which includes a fixed external casing 18 that extends between upper and lower flange structures 20*a*, 20*b*. In the variant of FIG. 1, the stationary housing 16 is fixed by its lower flange structure 20*b* to the top ring 21 of the furnace throat 12, which constitutes a machined flange.

Inside the housing 16, a suspension rotor, generally identified at 22, is rotationally mounted about a substantially vertical rotation axis A that corresponds e.g. to the blast furnace axis. This can be carried out by means of a large-diameter annular rolling bearing 24, generally a roller bearing and preferably a slewing bearing, supported by the stationary housing structure 16 and extending circumferentially about axis A.

The burden material discharged from above the device 10 and guided by funnel 14 flows through a central channel 26 in the device 10 and arrives at the distribution chute generally identified at 28. The inner dimensions of the central channel 26 generally depend on the cross-section of the suspension rotor 22. However, a feeding spout 30 is preferably arranged inside the suspension rotor 22 and fixedly mounted to the stationary housing 16. The axial extent of the feeding spout 30 may depend on the design. In the present variant the feeding spout 30 extends from the top opening 32 of the device 10 down to the chute 28. Since the feeding spout 30 is here placed inside rotor 22, the cross-section of channel 26 depends on the feeding spout 30.

The distribution chute 28 is mounted to the suspension rotor 22 so as to rotate in unison therewith about axis A. The chute 28 actually comprises a pair of lateral suspension arms 34 (or trunnions) by means of which it is suspended, in a known manner, to mounting bearings (not shown) in rotor 22 and that further allow its tilting/pivoting about a horizontal axis B. The chute 28 being generally installed in the lower region of the feed channel 26, the burden material—having entered the distribution device 10 at its top—falls, through rotor 22, into the chute 28 to be distributed in the furnace.

As it will be understood, the suspension rotor 22 and the stationary housing 16 cooperate to form the main casing 36 of the rotary charging device 10 and hence define a substantially closed annular chamber surrounding the central feed channel 26. In this connection, it may be noticed that in all of the figures the suspension rotor 22 is shown with dashed lines for the sake of illustration only, it does not imply that it should have some traversing openings in its body/bottom parts. In some cases, the main casing 36 may comprise one or more inner partition walls extending on whole or part of the circumference, as will be discussed below.

It may be noticed that suspension rotor 22 comprises a tubular support or body 38 that is arranged coaxial with the rotation axis A and that actually supports the chute 28. The tubular body 38 extends vertically in the central channel 26 and is operationally connected and supported by one race of the rolling bearing 24, the other race being fixedly attached, in this embodiment, to a fixed annular wall 39 of structure 16. Rotor 22 advantageously comprises a bottom 40 formed as an annular flange. The bottom 40 has a, amongst others, a protective function by forming a kind of screen between the interior of the main casing 36 and the interior of the furnace. The bottom 40 of the suspension rotor 22 extends laterally/radially in close proximity of the bottom flange structure 20*b* of the stationary housing 16.

Rotary drive means are provided for rotating the suspension rotor 22 about its axis A. It comprises an electric motor $M_R$, which is here fixed to the top of the housing 16 (outside thereof) with its output shaft 46 vertically arranged. The rotary motor $M_R$ is operatively coupled to the suspension rotor 22 by a main transmission. The main transmission may include an input gear 48 fixed on the output shaft 46 that drives a toothed annular ring 50 surrounding and rotationally integral with the suspension rotor 22. Toothed ring 50 is preferably fixed to the bearing race supporting rotor 22.

It shall be appreciated that the device 10 further comprises tilting drive means, independent from the rotary drive means, mounted to the suspension rotor 22 in such a way as to rotate therewith. Preferably, the tilting drive means are arranged on the bottom flange 40 of the rotor 22.

The tiling drive means comprise a tilting motor $M_B$, preferably an electric motor, installed in the main casing 36 and having a substantially horizontal output shaft 52. A tilting input gear 54 is driven by the tilting motor output shaft 52, whereas a tilting output gear 56 is rotationally integral with one pivoting arm 34 of the chute distributor 28, the tilting input gear 54 meshing with the tilting output gear 56. Preferably, the tilting motor output shaft 52 is substantially parallel to the pivoting axis B and preferably substantially aligned therewith, although not required.

In practice, the input gear 54 may be a wheel with external toothing while the output gear 56 may take the form of a concave toothed segment integral with the chute arm 34. Input gear 54 may be directly mounted to the output shaft 52 of motor $M_B$. However, a reduction gear set 60 is preferably arranged to operatively couple the motor's output shaft 52 and the input pinion 54, the latter being thus mounted on an intermediate tiling shaft 62. Reference sign 64 indicates one bearing that supports rotating shafts 62, but more such bearing may be employed. Although not shown, appropriate equipment may be used to support and fix the above-described main parts of the rotating and tiling drive means.

Preferably, for ease of control, the tiling drive means comprise similar drive means on both sides of the chute 28, which rest on the bottom 40 and rotate therewith.

A partition wall 37 divides the main chamber 36 into two concentric, annular sub-chambers $\mathbf{36}_1$, $\mathbf{36}_2$.

In use, the distribution chute 28 can thus be rotated about vertical axis A through actuation of rotary motor MR. The distribution chute is also pivotable about the horizontal axis, for adjusting the tilting angle of the chute and reaching various radiuses. As it will be understood, when the rotary motor MR is actuated, the rotor turns around axis A with the tilting drive means that it carries; the tilting drive means are fixed to the bottom 40 and there is no relative rotation about axis A between the tilting drive means and rotor 22.

The present rotary distribution device 10 has many benefits:

- the tilting and rotary drive means are decoupled/independent, which facilitates the mechanical design of the transmission systems;
- the horizontal installation of the tilting motor $M_B$ frees up some space in the region above the stationary housing
- the installation of the tilting motor $M_B$ on the suspension rotor's bottom flange 40 greatly simplifies the tilting drive mechanism, in particular because it is no longer required to transform the rotation of a vertical shaft into a horizontal movement;
- the tilting motor $M_B$ is arranged inside the main casing 36 and thus protected from the harsh outside environment.

Rotating electric motor $M_R$ is fixed and can be easily connected to a power source. The tilting motor $M_B$, which rotates with rotor 22, requires appropriate electric supply. Slip rings may be used to transfer power from the fixed housing portion to the rotating bottom. A contact-less solution such as an inductive power supply is however preferred, one for each motor $M_B$. Accordingly, an inductive coupling device may be used, which includes a stationary inductor 70 fixed to the stationary structure 16 and a rotary inductor 72 fixed to the rotor 22, e.g. at the periphery of bottom 40. The stationary inductor 70 and the rotary inductor 72 are separated by a radial gap and configured as rotary transformer for achieving contact-less electric energy transfer from the stationary support 16 to the rotor 22 by means of magnetic coupling trough the radial gap for powering tiling motor $M_B$ arranged on rotary bottom 40 and connected to rotary inductor 72. Such inductive coupling device are known in the art and have been described e.g. in WO 2008/074596; they will therefore not be further described herein.

Conventionally, the present rotary charging device may be equipped with any appropriate means to prevent the entrance of dust into the main casing 36. A nitrogen over-pressure may e.g. be maintained in the main casing 36. Seals, e.g. water seals, may also be arranged so as to close the operating gaps between the rotor 22 and the corresponding regions of the stationary housing 16.

Figure 2:
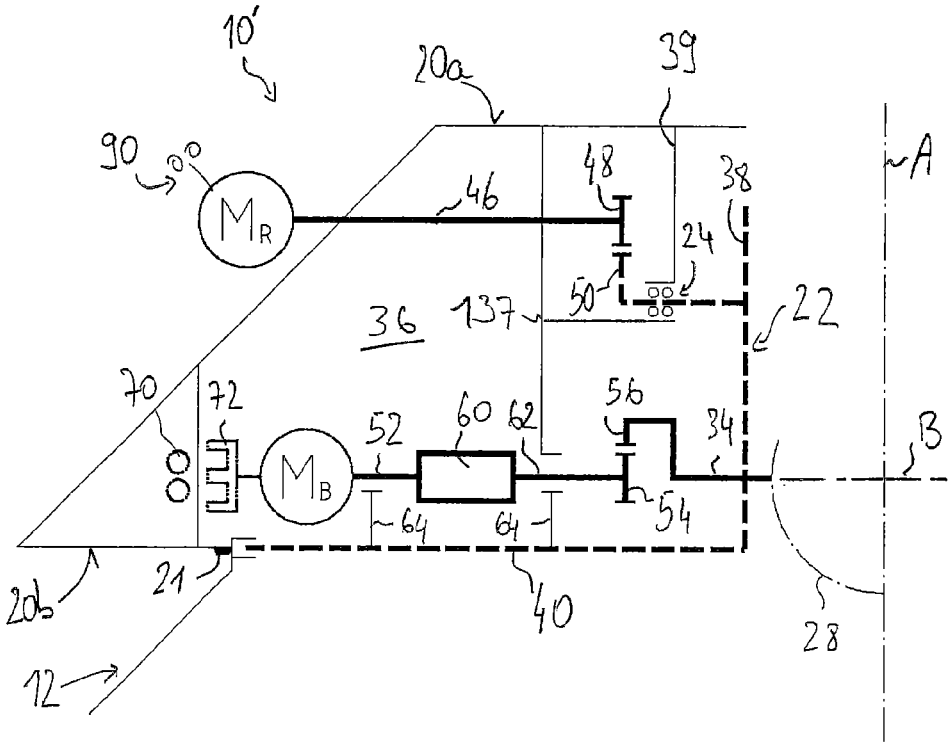
FIG. 2: is a schematic diagram, in half cross-section, of a second embodiment of the present rotary charging device.

FIG. 2 shows a second embodiment 10', which differs from that of FIG. 1 by the horizontal mounting of rotary motor $M_R$. Rotary motor $M_R$ is fixed with its output shaft substantially horizontal and arranged outside the main casing 36. This requires a minor change of the configuration of input gear 48, now vertical and ring gear 50 that has its teeth facing upwards instead of radially.

Figure 3:
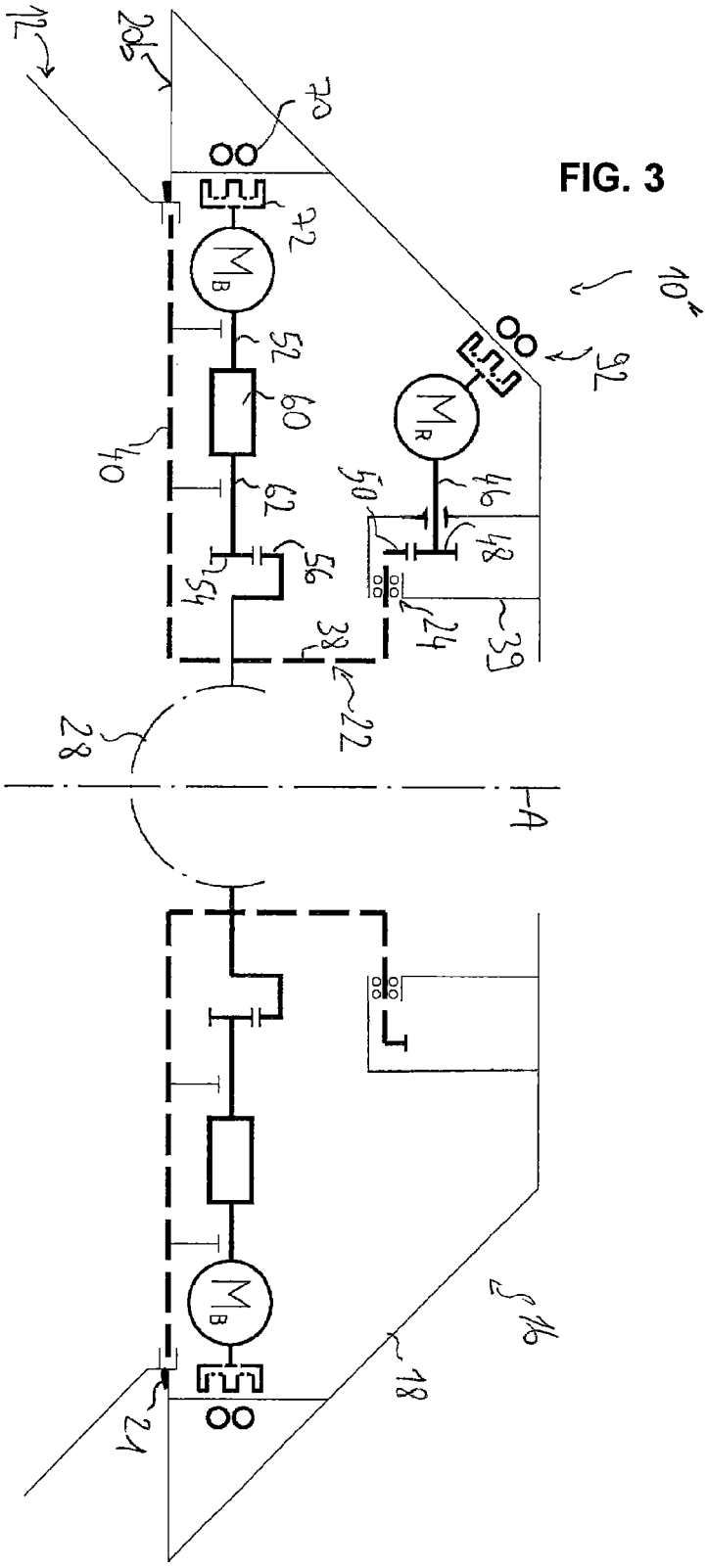
FIG. 3: is a schematic diagram, in cross-section, of a third embodiment of the present rotary charging device.

FIG. 3 shows a third embodiment 10", which is similar to that of FIG. 2 in that motor $M_R$ is horizontally mounted. Rotary motor $M_R$ is thus fixed with its output shaft horizontal, but the motor $M_R$ is here arranged inside the main casing 36.

The removal of the rotary motor $M_R$ from the top of the stationary housing 16 allows reducing the height of the device 10 and freeing up some space in this region where it is desirable to have access for maintenance on the rotary distribution device 10 itself (e.g. for chute maintenance/replacement) or on the storage hoppers and associated valves located just above the rotary distribution device 10. Moreover, it facilitates the access to motor $M_R$.

Figure 4:
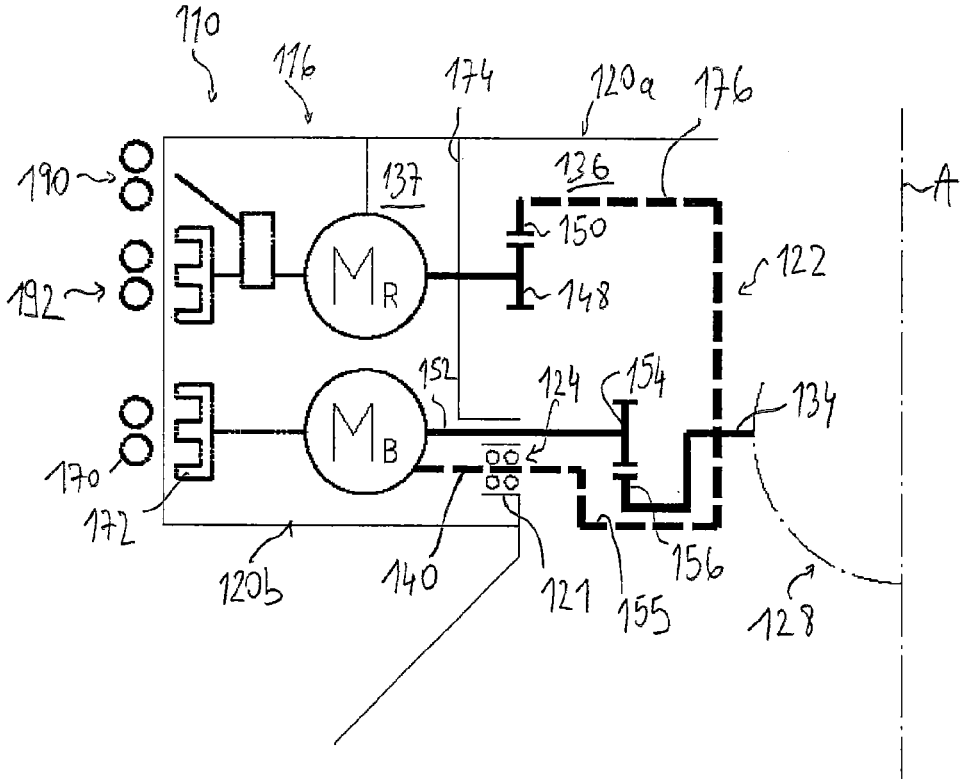
FIG. 4: is a schematic diagram, in half cross-section, of another embodiment of the present rotary charging device.

Turning now to FIG. 4, a third embodiment of the present device 110 is shown where the rolling bearing 124 (slewing ring) is mounted directly on the top ring 121 (machined flange) of the furnace top cone 112. As compared to FIG. 1, same or similar elements are indicated by same reference signs, augmented by 100. One race of rolling bearing 124 is thus fixed to the top ring 121, while the other is fixed to the lower surface of bottom 140. As in the other embodiments, the tilting drive means are carried by the rotary bottom 140 and preferably supplied by means of an inductive coupling device with cooperating inductors 70, 72. The tilting drive means are preferably symmetrically arranged and include a reduction gear set (not shown) coupled to the tilting Motor's output shaft 152. The output shaft 152 is rotationally integral with an input gear 154. In this embodiment however, to further reduce the height of the device 110 above the furnace top cone 113, the output gear 156 connected to the pivoting arm 134 of the chute 128 is arranged below the input gear 154, in a recess 155 provided in bottom 40. Rotary motor $M_R$ is also arranged inside main casing 136, preferably with tilting motor $M_B$ inside a sub-chamber 137 delimited by an annular partition wall 174 extending from the top flange 120*a* down to the level of the tilting shaft 152.

One will also notice the peculiar shape of rotor 122 that, in this variant, has a horizontal wall portion 176 extending from the feed channel towards the interior of the main casing 136. The ring gear 150 associated with the rotor 122 is fixed at the outer end of said wall portion 176.

Figure 5:
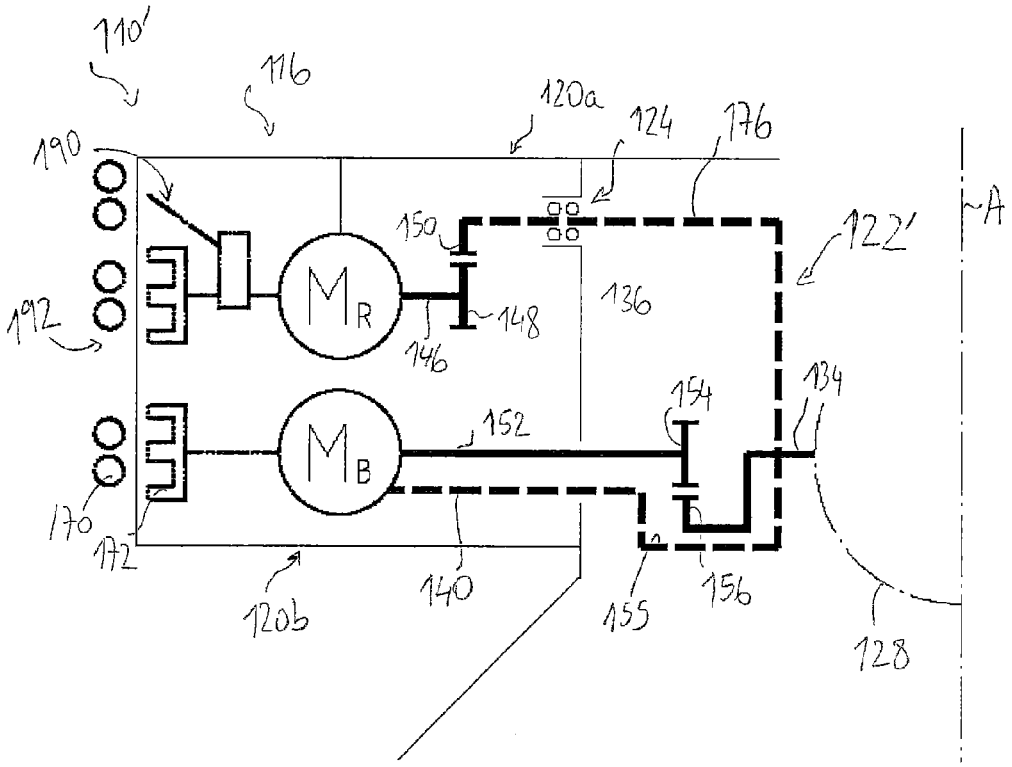
FIGS. 5 to 12: are schematic cross-sectional diagrams of still further embodiments of the present rotary charging device.

The embodiment 110' illustrated in FIG. 5 is quite similar to that of FIG. 4, with a similarly configured suspension rotor 122'. The suspension rotor 122' is however suspended by way of a rolling bearing 124 arranged in the upper part of the device 110', one race being affixed to the upper flange structure 120*a* and the other race being connected to the horizontal wall portion 176 of suspension rotor 122'.

Figure 6:
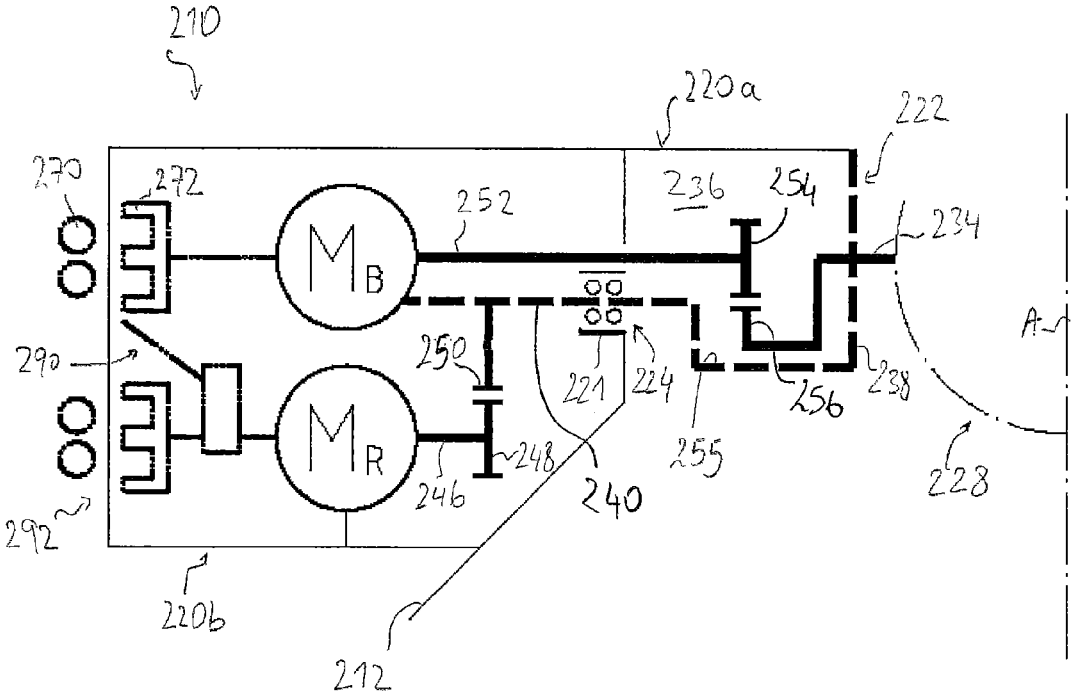

To even further reduce the height of the rotary distribution device and hence of the top charging installation, the rotary motor $M_R$ can be arranged below the tilting motor $M_B$, as shown in the embodiment of FIG. 6. Same or similar elements are identified by same reference signs, augmented by 100 with respect to FIG. 4. Here, again, one rolling bearing 224 only is required, and mounted directly onto the top ring 221 of the blast furnace top cone 212. The suspension rotor 222 has a short cylindrical body 238, as compared to FIG. 1, since room above bottom 240 is only required for accommodating the tilting drive means and fixing the chute 228. As in FIG. 4, the rotary bottom 240 is directly supported by one race of rolling bearing 224, while the cooperating race is fixed to the top ring 221. The arrangement of the tilting drive means on the bottom 240 is also similar to FIG. 4.

A substantial reduction in height is thus provided by the arrangement of the fixed rotary motor $M_R$ below the tilting motor $M_B$, respectively below the rotary bottom 240. In practice, it is considered that a reduction of height of about ⅔ can be achieved, leading to a total height (between lower 220*b* and upper 220*a* flanges) of the rotary distribution device of about 0.5 m.

In this variant, toothed ring 250 is preferably fixed directly to the lower side of bottom 240, or on a short spacer sleeve. Motor $M_R$ is horizontally arranged and has on its horizontal output shaft 246 an input gear 248 meshing with toothed ring 250.

Figure 7:
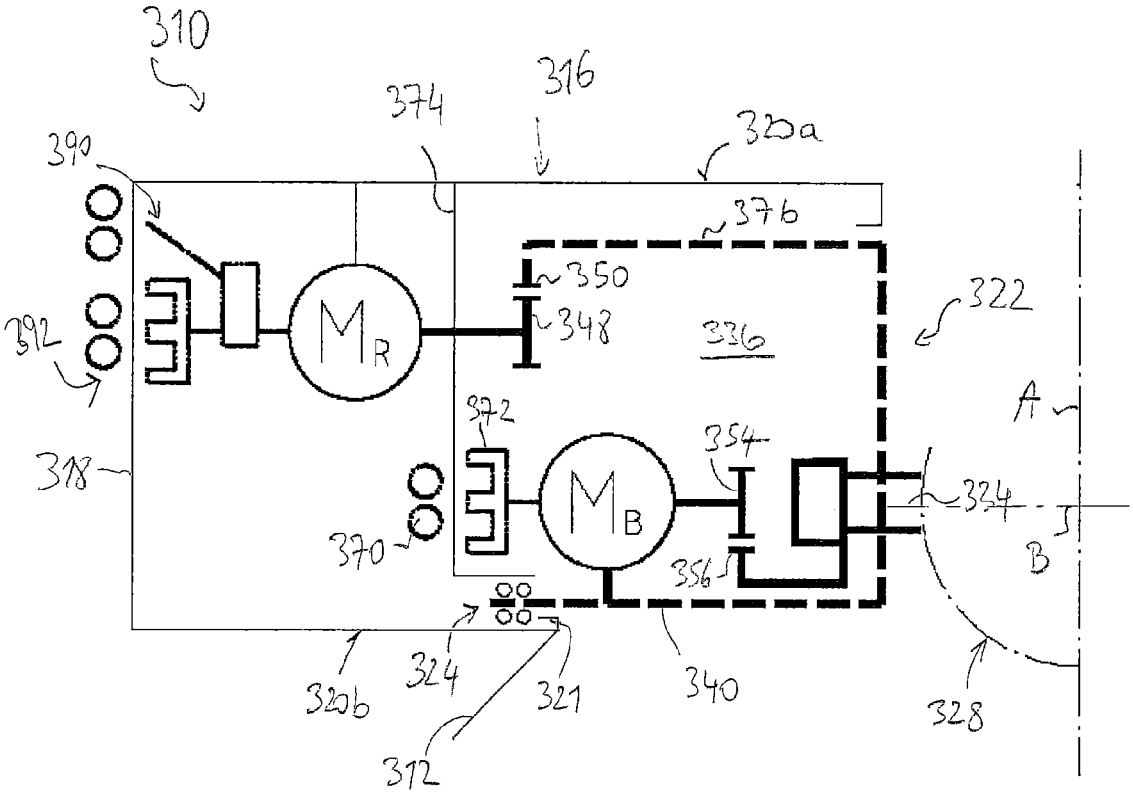
Figure 8:
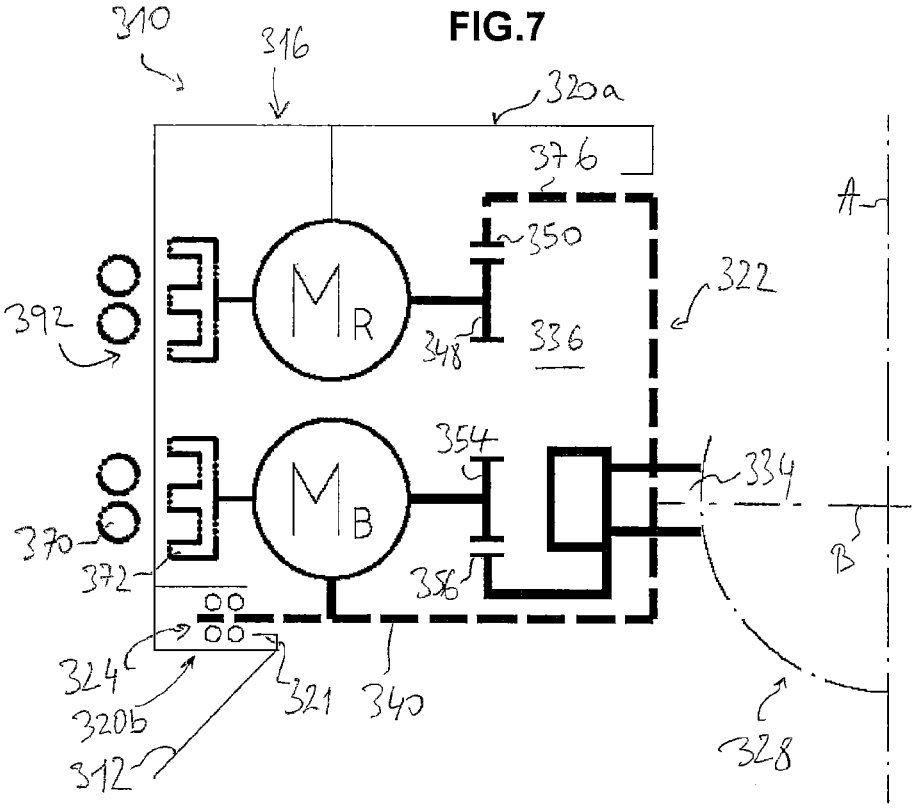

FIGS. 7 and 8 describe two alternative embodiments where the rolling bearing 324 (slewing ring) is mounted to the lower flange 320*b* of the stationary housing 316. The lower flange 320 is conventionally fixed to the furnace throat 312, e.g. at its top ring 321. Identical or similar elements are designated with same reference signs as compared to FIG. 4, augmented by 200.

The suspension rotor 322 is supported by rolling bearing 324, one race of which is fixed to the lower side of rotor bottom 340, e.g. in the region of its periphery, the other directly to the lower flange 320*b* or optionally via a support member (not shown).

The tilting drive means are mounted to the bottom 340 of suspension rotor 322, however closer to the chute 328. The output gear 356 is located below the tilting input gear 354, as in the variant of FIG. 4 but without recess in the bottom 340.

The rotation drive means includes its fixed electric motor $M_R$ and has an input gear 348 cooperating with a ring gear 350 attached to a horizontal wall portion 376 of rotor of rotor 322.

In the embodiment of FIG. 7, an annular wall portion 374 is fixed to the upper flange 320*a* of the stationary housing 316 and divides the main casing 336 into separate, outer and inner annular chambers. The rotary motor $M_R$ is thus arranged in the outer annular sub-chamber and the tilting motor $M_B$ in the inner annular chamber.

By contrast, in the embodiment of FIG. 8 presenting a laterally compact solution, both motors $M_R$ and $M_B$ and located in the main casing 336, without sub-division. It may be noticed that in the embodiments of FIGS. 4 to 8, the tilting output gear 156, 256 or 356 is shown below the input gear 154, 254, 354 in the recessed rotor flange 140. But the bottom flange 140 could also be flat, and the tilting output gear arranged above the input gear, as in FIG. 1.

Figure 9:
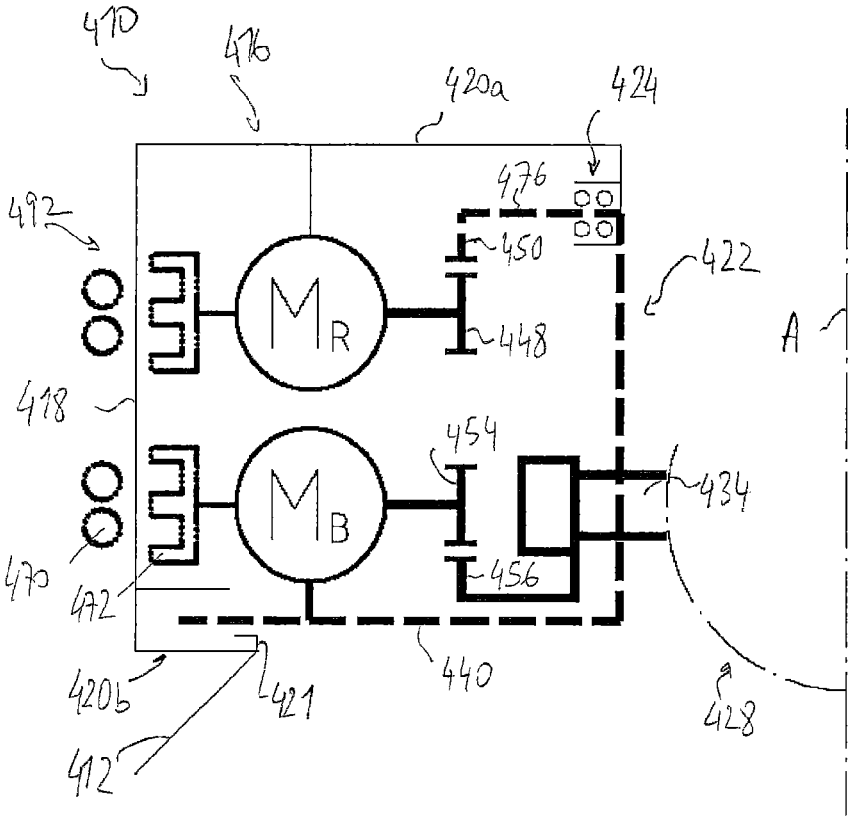

FIG. 9 presents an embodiment rotary distribution device 410 similar to that of FIG. 7, where the rolling bearing 424 is however located in the upper region of the stationary housing 416. As compared to FIG. 7, identical or similar elements are indicated by same reference signs, augmented by 100. The design of the stationary rotor 422 and the tilting and rotating drive arrangements are similar to FIG. 7.

Rolling bearing 424 has one race fixed to the upper flange 420*a* of stationary housing 416 and the other race fixed to the suspension rotor 422, e.g. to the upper wall 476.

Figure 10:
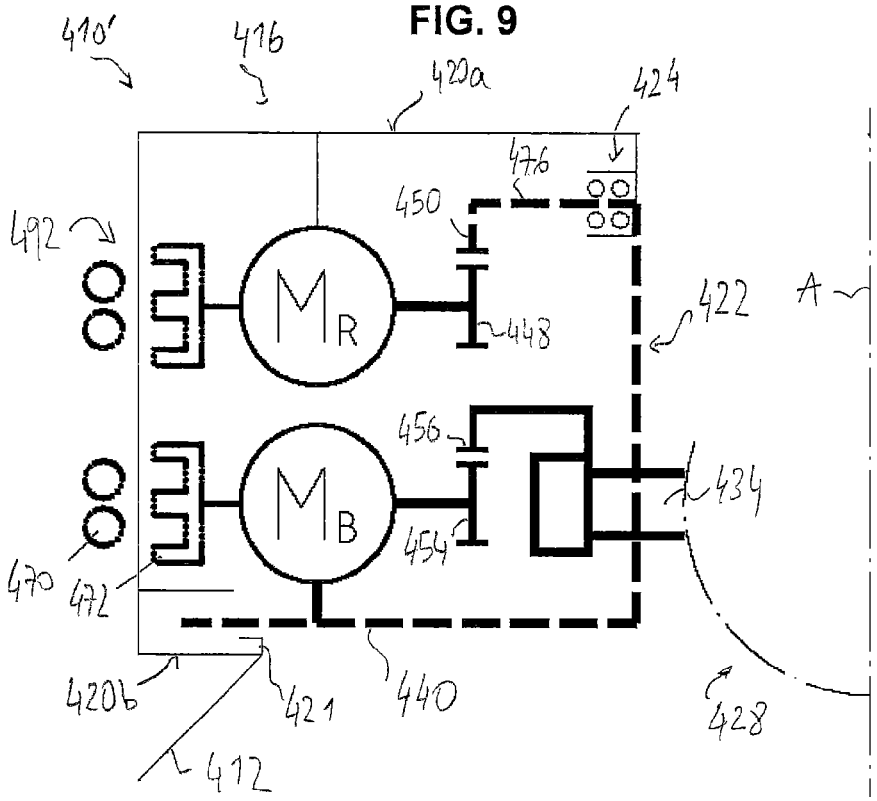

The embodiment 410' of FIG. 10 differs slightly from FIG. 9 in the tilting drive means, where the output gear 456 is located above the input gear 454.

Figure 11:
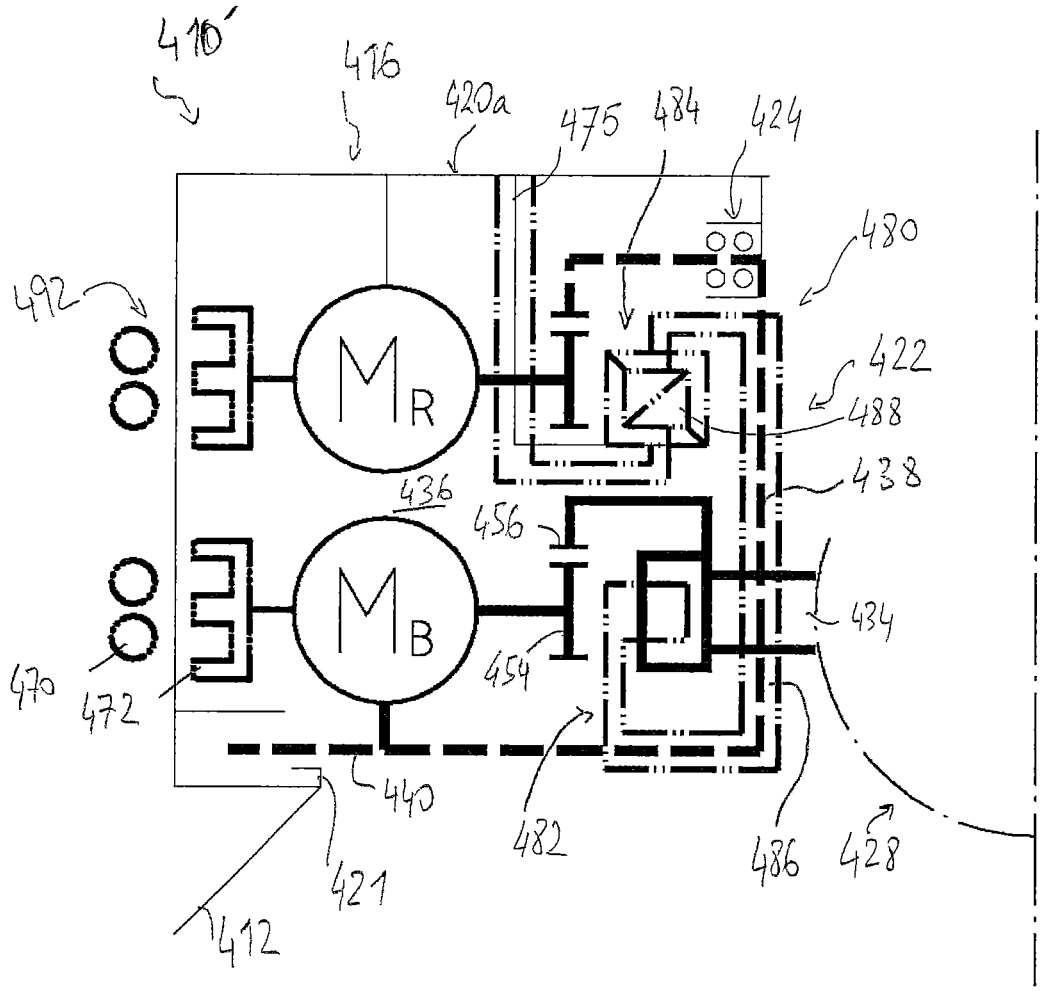

Turning now to FIG. 11, the configuration is the same is in FIG. 10, but further shows a possible realization of an additional cooling system 480. The cooling system comprises a rotary circuit portion 482 fixed on the suspension rotor 422 and a stationary circuit portion 484 fixed to the stationary housing 416, here actually to an annular, L-shaped wall portion 475. During operation, the rotary circuit portion 482 rotates with the suspension rotor 422, whereas the stationary circuit portion 484 remains immobile with the housing 416. The rotary circuit portion 482 comprises any suitable heat exchanger, e.g. a heat exchanger comprising several cooling pipe coils 486, that are arranged on the suspension rotor 422. The coils 486 are in thermal contact with the rotor's body portion 438 and its bottom flange 440, on the side of the main casing 436, in order to cool parts of the charging device 410', which are most exposed to the furnace heat. In addition, the rotary circuit portion 482 also provides cooling of the drive and gear components arranged in the housing 416.

Although not shown in FIG. 11, the rotary circuit portion 482 may comprise additional cooling pipes/coils, e.g. for cooling the distribution chute 428 itself, or any other suitable kind of heat exchanger configuration. Cooling systems for rotary distribution devices are well known in the art and will not be further described herein. For further details on cooling system, one may refer to WO 2011/023772, which is herein incorporated by reference. In this connection, the cooling system 480 is preferably further configured to achieve forced circulation of coolant (e.g. water) from the stationary circuit portion 484 to the rotary circuit portion 482 and vice-versa, while the latter portion 482 rotates relative to the former portion 484. To this effect, the cooling system 480 may include an annular swivel joint 488, which fluidically couples both circuit portions 482, 484. The annular swivel joint 488 is provided in an upper portion of the stationary housing 416, e.g. on the horizontal part of fixed annular wall portion 475, other locations being possible. The swivel joint 488 is of generally annular configuration and arranged coaxially on axis A, e.g. so as to surround the feed channel 426.

Figure 12:
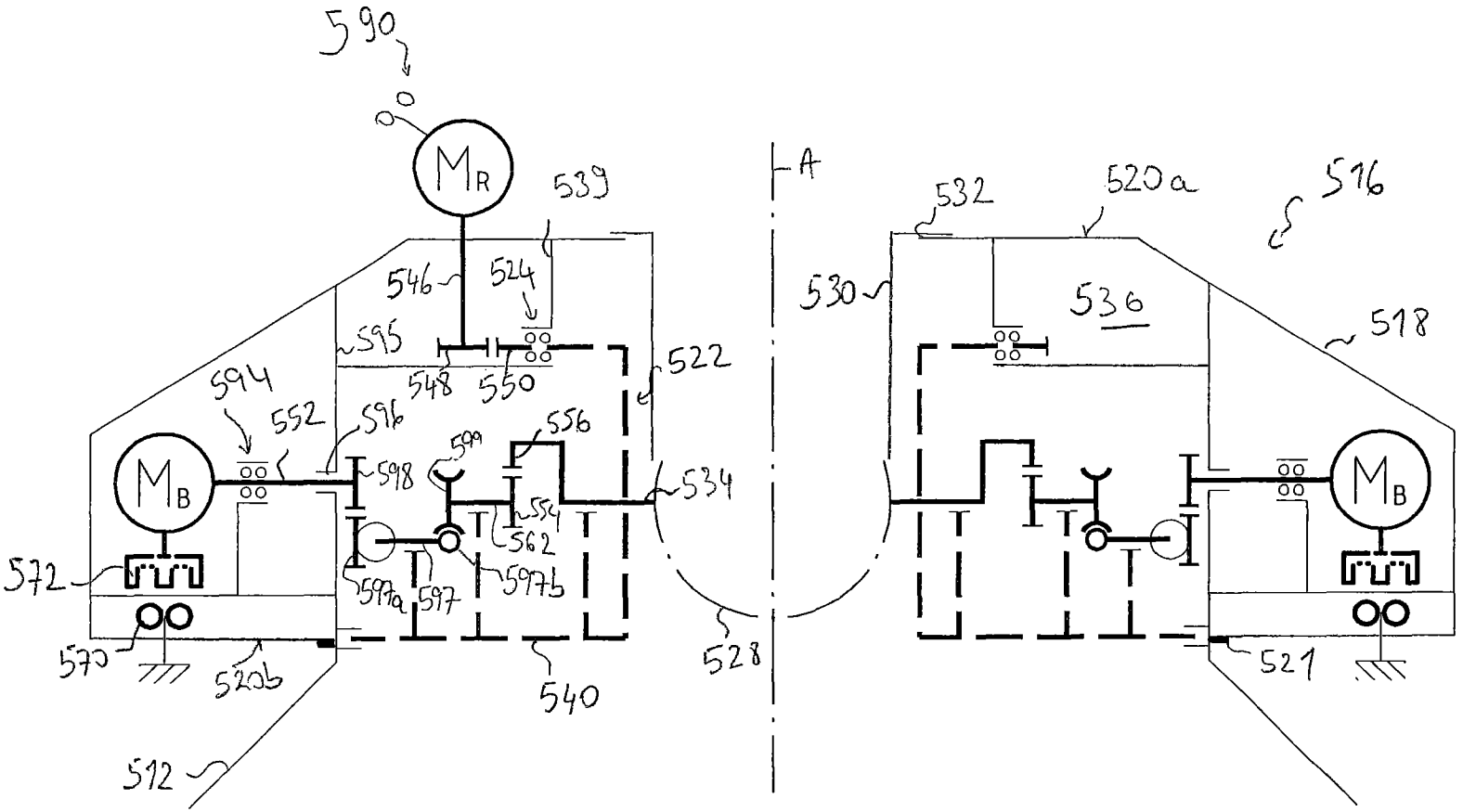

A last embodiment is illustrated in FIG. 12. The same elements as in FIG. 1 are indicated by same reference signs, augmented by 500. This embodiment differs in that the tilting Motor $M_B$ is radially deported and no longer rests directly on the rotor's bottom flange 540. This requires a different configuration of the tilting drive means. Although the tilting motor $M_B$ is not installed on the rotor flange 540, it is carried along by the rotor 522 as it rotates. Therefore, the tilting motor $M_B$ has its output shaft 552 horizontally arranged and supported on a large diameter annular rolling bearing 594 fixed to the flange structure 520*b*, that allows rotation of motor $M_B$ all over the circumference. Tilting Motor $M_B$ is preferably arranged behind an intermediate wall 595, with an annular slot 596 for the output shaft 552. The motor's torque is transmitted to the tiling shaft 562 mounted to the rotor bottom 540 by a transmission mechanism comprising: an intermediate shaft 597 having an intermediate gear 597*a* and a worm 597*b* fixed thereto. The intermediate gear 597*a* meshes with a drive pinion 598 mounted to the output shaft 594. The worm 597*b* meshes in turn with a worm wheel 599 mounted at end of the tilting shaft 562. The other end of tilting shaft 562 carries the input gear 554 meshing with the output gear 556 rotationally integral with the chute's suspension arm 534.

A few remarks remain to be made regarding all of the above-described embodiments.

For the sake of simplicity and clarity of drawing, most embodiments have been described on the basis of a half-cross sectional view, specifically a section view on the left of axis A. In these half-cross sectional views, only one suspension arm of the distribution chute is shown, with the tiling motor $M_B$ and associated transmission. It should however be understood that in practice, the tilting drive means preferably comprise two similar tilting drive means with horizontal tiling motors $M_B$ and appropriate transmission connected each to a respective suspension arm of the distribution chute. The use of similar tilting drive means on opposite sides of the distribution chute is shown in FIGS. 1 and 3.

Another common aspect of the various embodiments is the power supply. Preferably, an inductive power supply is used to supply the tilting motors $M_B$. The rotating motor $M_R$ being fixed, it can simply and efficiently be powered by wire. Nevertheless, when installed inside the main casing, one could also use a non-wired power supply as for the rotating tilting motors $M_B$.

In some of the Figures, both supply possibilities for $M_R$ are illustrated; the following notation is used:

the wired power supply is designated 90, 190, 290, 390;

and the inductive power supply is generally indicated 192, 292, 392, 492.

Finally, as described with respect to FIG. 1, the present rotary distribution devices may advantageously be equipped with any appropriate means to prevent the entrance of dust into the main casing 36, e.g. by means of a nitrogen overpressure. In addition, seals, e.g. water seals, may be arranged so as to close the operating gaps between the rotor 22 and the corresponding portions of the stationary housing 16.

The invention claimed is:

1. A rotary charging device for a shaft furnace comprising:

a stationary housing for mounting on the throat of the shaft furnace; a suspension rotor in said stationary housing that is supported so that it can rotate about a substantially vertical axis, said suspension rotor and stationary housing cooperating to form the main casing of said rotary charging device; a charge distributor pivotally suspended to said suspension rotor; rotary drive means for rotating the suspension rotor about its axis; tilting drive means for pivoting said charge distributor about a substantially horizontal pivoting axis, independently from said rotary drive means, wherein:

said tilting drive means are mounted onto said suspension rotor and rotate therewith, a tilting motor is installed inside said main casing and has a substantially horizontal output shaft, said tilting motor being arranged so as to rotate with said suspension rotor;

a tilting input gear is driven by said tilting motor output shaft; and a tilting output gear is rotationally integral with a suspension arm of said chute distributor, said tilting input gear meshing with said tilting output gear.

2. The rotary charging device according to claim 1, wherein said suspension rotor comprises a cylindrical body and a bottom flange.

3. The rotary charging device according to claim 2, wherein said tilting drive means are supported by said bottom flange.

4. The rotary charging device claim 1, wherein:

a rotary motor is mounted laterally to said stationary housing or inside said stationary housing with its output shaft substantially horizontal; and said rotary drive means comprise a main transmission with an input gear driven by said output shaft and meshing with a toothed ring coaxial and rotationally integral with said suspension rotor.

5. The rotary charging device according to claim 4, wherein said toothed ring is fixed to a lower side of said bottom flange; and said input gear driven by said rotary motor is arranged below said bottom flange in meshing engagement with said toothed ring.

6. The rotary charging device according to claim 5, wherein said suspension rotor is rotationally supported by a rolling bearing mounted to a top ring of said shaft furnace, one race of said rolling bearing being fixed to the lower side of the suspension rotor's bottom flange.

7. The rotary charging device according to claim 1, wherein said suspension rotor is rotationally supported by a rolling bearing, a first race of which is attached to a wall portion of said suspension rotor and a second race of which is attached to a fixed structure.

8. The rotary charging device according to claim 7, wherein the first race is attached to an upper horizontal wall portion of said suspension rotor and the second race is attached, directly or indirectly, to the upper flange of said stationary housing; or said first race is attached to the bottom flange of said suspension rotor and the second race is attached to one of the lower flange of said stationary housing and the top ring of the shaft furnace.

9. The rotary charging device according to claim 1, wherein said tilting motor output shaft is substantially parallel to said pivoting axis.

10. The rotary charging device according to claim 1, wherein said suspension rotor comprises a bottom with a recessed portion in which an output gear driven by said tilting motor and rotationally integral with a suspension arm of said distribution chute is arranged.

11. The rotary charging device according to claim 1, wherein said tilting motor is located in a sub-chamber of said main casing, with its output shaft passing through a partition wall of said main casing.

12. The rotary charging device according to claim 1, wherein a rotary motor is mounted with its output shaft substantially vertical and a main transmission comprises an input gear driven by said output shaft and meshing with a toothed ring coaxial with and rotationally integral with said suspension rotor.

13. The rotary charging device according to claim 1, wherein the tilting drive means comprise a worm gear set coupling said the tilting motor output shaft to said input gear, said tilting motor being supported with its output shaft by an annular rolling bearing so as to be carried along by the rotating suspension rotor.

14. The rotary charging device according to claim 1, comprising wherein inductive power supply means are provided for supplying electric power to said tilting motor.

15. The rotary charging device according to claim 1, comprising wherein an additional cooling system is provided, said additional cooling system including a rotary circuit portion fixed on the suspension rotor and a stationary circuit portion fixed to the stationary housing.

16. A shaft furnace, in particular a blast furnace, comprising a rotary charging device according to claim 1.

17. The rotary charging device according to claim 7, wherein said rolling bearing comprises a slewing ring.

18. The rotary charging device according to claim 1, wherein said tilting motor is an electric motor.

* * * * *